US011953268B2

(12) United States Patent
Huang

(10) Patent No.: US 11,953,268 B2
(45) Date of Patent: Apr. 9, 2024

(54) TIGHT-FIT RIVETING STRUCTURE FOR CLUSTERED RADIATION FIN SET AND HEAT PIPE AND RIVETING METHOD

(71) Applicant: Dongguan Hanxu Hardware Plastic Technology Co., Ltd., Guangdong (CN)

(72) Inventor: Tsung-Hsien Huang, Dongguan (CN)

(73) Assignee: DONGGUAN HANXU HARDWARE PLASTIC TECHNOLOGY CO., LTD., Guangdong (CN)

( * ) Notice: Subject to any disclaimer, the term of this patent is extended or adjusted under 35 U.S.C. 154(b) by 0 days.

(21) Appl. No.: 17/728,988

(22) Filed: Apr. 26, 2022

(65) Prior Publication Data

US 2023/0235968 A1 Jul. 27, 2023

(30) Foreign Application Priority Data

Jan. 21, 2022 (CN) ..... 202210071271.0

(51) Int. Cl.

| | |
|---|---|
| ***F28D 15/02*** | (2006.01) |
| ***B21D 53/02*** | (2006.01) |
| ***F28D 15/04*** | (2006.01) |
| ***F28F 7/00*** | (2006.01) |
| ***H05K 7/20*** | (2006.01) |

(52) U.S. Cl.
CPC ..... *F28D 15/0275* (2013.01)

(58) Field of Classification Search
CPC ..... F28D 15/0275; F28D 15/02; F28D 15/04
USPC ..... 165/104.26, 104.21
See application file for complete search history.

(56) References Cited

U.S. PATENT DOCUMENTS 7,120,026 B2 * 10/2006 Chen ..... H01L 23/3672 361/704
7,387,155 B2 * 6/2008 Chen ..... H01L 23/467 257/E23.099
2006/0070721 A1 * 4/2006 Chen ..... F28D 15/0275 257/E23.103
2008/0028610 A1 * 2/2008 Chen ..... H01L 23/427 29/890.032
2009/0038777 A1 * 2/2009 Chen ..... F28D 15/0275 29/890.032
2010/0025018 A1 * 2/2010 Chen ..... F28D 15/0275 165/104.33

(Continued)

FOREIGN PATENT DOCUMENTS

DE 202010010379 U1 * 11/2010 ..... F28D 15/0266
WO WO-2021035125 A1 * 2/2021 ..... G06F 1/20

*Primary Examiner* — Len Tran
*Assistant Examiner* — Gustavo A Hincapie Serna
(74) *Attorney, Agent, or Firm* — Leong C. Lei

(57) ABSTRACT

A tight-fit riveting structure for a clustered radiation fin set and a heat pipe and a riveting method include a radiation fin set formed by locking a plurality of radiation fins together and at least one heat pipe. The radiation fin set has an accommodation slot for accommodating the heat pipe. The heat pipe is positioned in the accommodation slot for a tight fit by subjecting two sides of the accommodation slot of the radiation fin set to a riveting operation. First riveting and deforming portions defined on two sides of a communication mouth of the accommodation slot are riveted towards a surface of the heat pipe, which causes the deformation of the first riveting and deforming portions whereby the heat pipe is clamped in a tight fit manner.

2 Claims, 17 Drawing Sheets

(56) References Cited

U.S. PATENT DOCUMENTS

2011/0005726 A1* 1/2011 Zhang ..... H01L 23/467
228/183
2011/0162206 A1* 7/2011 Chen ..... H01L 21/4882
29/428
2011/0290449 A1* 12/2011 Huang ..... F28D 15/0275
165/104.26
2011/0297356 A1* 12/2011 Hsieh ..... F28D 15/0233
165/104.26
2011/0315365 A1* 12/2011 Chen ..... F28F 1/12
165/185
2013/0014917 A1* 1/2013 Huang ..... F28D 15/0275
165/104.26
2013/0048255 A1* 2/2013 Xia ..... H01L 23/427
165/121
2013/0105121 A1* 5/2013 Xia ..... H01L 23/3672
165/185
2013/0118717 A1* 5/2013 Lin ..... F28F 1/24
29/890.03
2014/0238644 A1* 8/2014 Hsieh ..... H01L 23/427
29/890.032
2014/0345830 A1* 11/2014 Jang ..... H01L 23/3672
165/104.21
2020/0217598 A1* 7/2020 Huang ..... G06F 1/20
2022/0243991 A1* 8/2022 Lin ..... H01L 23/3672

* cited by examiner

TIGHT-FIT RIVETING STRUCTURE FOR CLUSTERED RADIATION FIN SET AND HEAT PIPE AND RIVETING METHOD

BACKGROUND OF THE INVENTION

1. Field of the Invention

This invention relates to a heat dissipation device and relates particularly to a tight-fit riveting structure for a clustered radiation fin set and a heat pipe and its riveting method.

2. Description of the Related Art

Nowadays it is very common that a heat dissipation structure is equipped with radiation fins and a heat pipe. The tightness between the radiation fins and the heat pipe affects the efficiency of dissipating heat directly.

For example, Chinese Patent Publication No. CN100450660C discloses a method of tightly combining a heat pipe with radiation fins wherein a through hole with a closed-ring shape is formed on a radiation fin. The method includes locking spaced-apart radiation fins together with fasteners to define a radiation fin set, then passing a heat pipe through the through holes of the radiation fins, and thence carrying out a tightly-forming process which is related to the use of multi-presses and pressurization whereby surfaces of annularly protruding walls of the radiation fins are pressed and deformed by pressurizing with great force, and then a forced deformation is caused so that the annularly protruding walls and the heat pipe are integrated to complete a heat dissipation device. This structure inevitably requires that the through holes are much larger than the heat pipe to allow the heat pipe to pass through the through holes of the radiation fins after defining the radiation fin set. However, although the annularly protruding walls can be integrated with the heat pipe under the forced deformation, there is space between the through holes and the heat pipe because of the closed-ring condition, and this situation affects the efficiency of heat dissipation. In addition, the radiation fins are merely bunched together by using fasteners, but the strength of the whole bunch of the radiation fins is not perfect, especially when the shape and the dimension of the radiation fins are easily changed while being subjected to the pressurization with great force, and such change affects the strength of the whole configuration.

SUMMARY OF THE INVENTION

To solve the above problems, a primary object of this invention is to provide a tight-fit riveting structure for a clustered radiation fin set and a heat pipe and a riveting method, which allow radiation fins to fit the heat pipe in a tight fit manner whereby the contact area between the radiation fins and the heat pipe is efficiently increased to enhance the clamping strength, increase the stability of combining the radiation fins with the heat pipe and the tightness of the tight fit, and promote the heat dissipation effect. Furthermore, the riveting method is simple and reliable and is easy to operate. The method can also be in widespread use.

To fulfill the above object, the technique of this invention is described as follows.

A tight-fit riveting structure for a clustered radiation fin set and a heat pipe includes a radiation fin set defined by locking a plurality of radiation fins together and at least one heat pipe. The radiation fin set includes an accommodation slot adapted to accommodate the heat pipe. The heat pipe is located in the accommodation slot, and the heat pipe is positioned in the accommodation slot in a tight fit manner by subjecting two sides of the accommodation slot of the radiation fin set to a riveting operation.

The radiation fins each include a fin body. The accommodation slot is formed on the fin body and formed by passing through a front face and a rear face of the fin body. The accommodation slot defines a communicating mouth passing through a peripheral edge of the fin body. The peripheral edge of the fin body has respective deformation notches which are recessedly formed on two sides of the communicating mouth. A first bending part is formed by bending a periphery of the accommodating slot of the fin body forwardly. The first bending part is bent with respect to the fin body by an L shape. A region of the first bending part of the radiation fin located between the deformation notches and the communicating mouth is defined as first riveting and deforming portions.

Two side edges of the fin body are each bent forwardly and provided with an engagement plate. An engagement hole is formed on the engagement plate to accommodate the engagement plate. The radiation fins are locked together as a clustered radiation fin set by embedding the engagement plate of one radiation fin into another engagement hole of another engagement plate of another adjacent radiation fin in front.

After the heat pipe is disposed in the accommodation slot of the radiation fin set formed by clustering the radiation fins together, the first riveting and deforming portions on the two sides of the communicating mouth of the accommodation slot are riveted towards a surface of the heat pipe to cause a deformation of the first riveting and deforming portions whereby the heat pipe is clamped in a tight fit manner. By the first bending part and the deformation notches, the region of the first bending part located between the deformation notches and the communicating mouth are defined as first riveting and deforming portions. The deformation notches can reduce stress while riveting to benefit the riveting operation of the first riveting and deforming portions, thereby attaining a tight fit between the radiation fins and the heat pipe.

A method of riveting a clustered radiation fin set to a heat pipe in a tight fit manner is based on the aforementioned tight-fit riveting structure for the clustered radiation fin set and the heat pipe. The method includes following steps.

Step 1: locking all of the radiation fins in succession whereby the radiation fin set is defined and then putting the heat pipe into the accommodation slot formed on the radiation fin set.

Step 2: putting the clustered radiation fin set and the heat pipe into a lower fixing die. A top of the lower fixing die is provided with a plurality of lower positioning plates which are arranged to correspond to spaces between adjacent radiation fins of the radiation fin set. The lower positioning plates are adapted to abut against a bottom of each first bending part.

Step 3: preparing a riveting punch, the bottom of which is provided with a plurality of upper positioning plates which are arranged to correspond to the spaces between adjacent radiation fins of the radiation fin set, and riveting the first riveting and deforming portions towards the heat pipe by a pressing of the upper positioning plates of the riveting punch so that the first riveting and deforming portions are deformed to clamp the heat pipe in a tight fit manner.

By comparison with the convention technique, this invention has distinct advantages and beneficial effects. Specifically, this invention mainly takes advantage of the first bending part and the deformation notches to define the first riveting and deforming portions, i.e. a region of the first bending part located between the deformation notches and the communicating mouth. The deformation notches can reduce stress while riveting to help carry out the riveting operation of the first riveting and deforming portions, thereby attaining a tight fit between the radiation fins and the heat pipe. Therefore, the tight fit therebetween increases a contact area between the radiation fins and the heat pipe efficiently, enhances the clamping strength, promotes the stability of combining the radiation fins with the heat pipe and the tightness of the tight fit, and promotes the heat dissipation effect. This invention also takes advantage of the lower fixing die and the riveting punch to subject the radiation fins and the heat pipe to the riveting operation to fulfill the tight fit therebetween. The riveting method is simple and reliable and is easy to operate. The method can also be in widespread use.

DETAILED DESCRIPTION OF THE PREFERRED EMBODIMENTS

Figure 1:
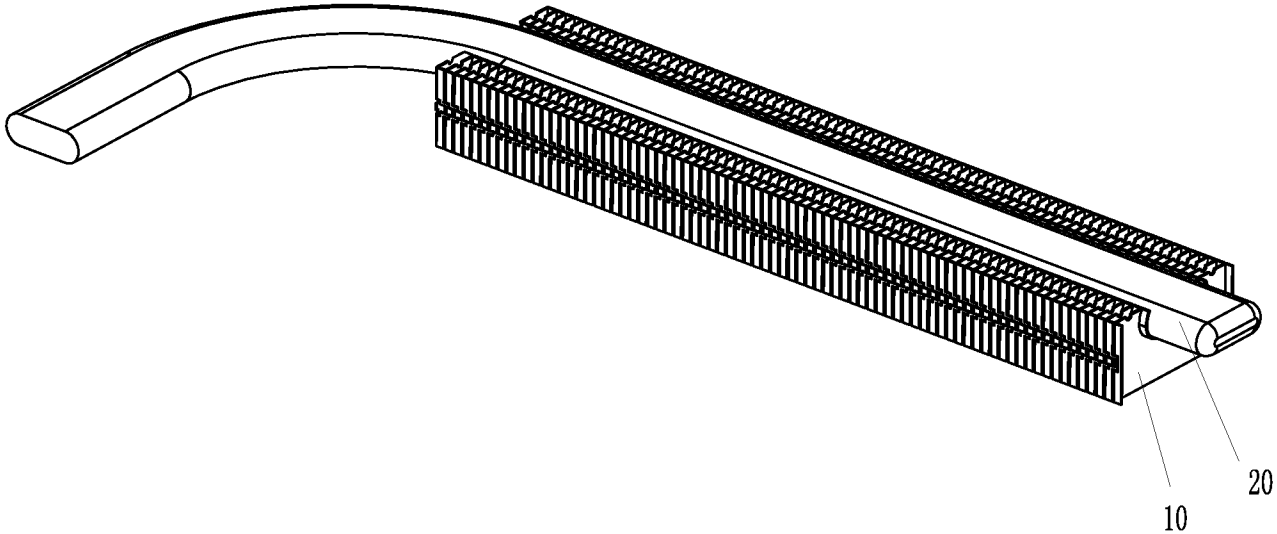
FIG. 1 is a schematic view showing a first preferred embodiment of this invention in a state of assemblage.
Figure 2:
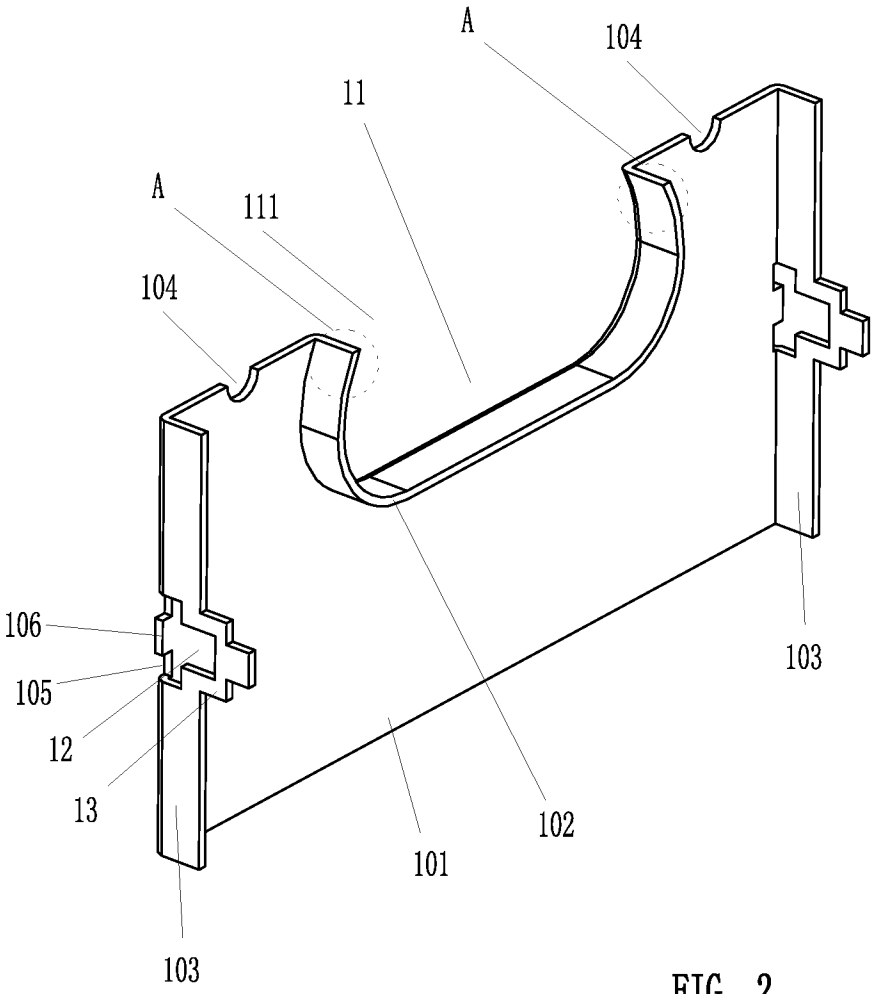
FIG. 2 is a schematic view showing a radiation fin of the first preferred embodiment of this invention.

Referring to FIG. 1 through 5, a structure of a first preferred embodiment is shown.

A tight-fit riveting structure for a clustered radiation fin set and a heat pipe is disclosed. It includes a radiation fin set defined by locking a plurality of radiation fins 10 with each other and at least one heat pipe 20. The radiation fin 10 has an accommodation slot 11 formed thereon and adapted to accommodate the heat pipe 20. The heat pipe 20 is located in the accommodation slot 11, and the heat pipe 20 is positioned in the accommodation slot 20 by riveting the radiation fins 10.

The radiation fin 10 includes a fin body 101. The accommodation slot 11 is formed on the fin body 101 and formed by passing through a front face and a rear face of the fin body 101. The inner shape and dimension of the accommodation slot 11 can be slightly larger than the heat pipe 20, thereby providing an interference fit. The accommodation slot 11 has a communicating mouth 111 communicating with the outside so that the accommodation slot 11 is formed in a non-closed ring shape. The communicating mouth 111 passes through a peripheral edge of the fin body. It is stated herein that the communicating mouth 111 is defined on an upper face of the fin body 101. Considering the installation of the heat pipe 20, the radiation fins 10 can be partially deformed so that the communicating mouths 111 of the radiation fins 10 are slightly opened for an outward deformation whereby the heat pipe 20 is easily put therein. After putting the heat pipe 20, the shape of the radiation fins 10 fits the shape of the heat pipe 20 very well to help increase the tightness of the riveting combination. It is possible to install the heat pipe 20 by penetration without passing through the communicating mouth 111. The peripheral edge of the fin body 101 has respective deformation notches 104 which are recessedly formed on two sides of the communicating mouth 111. A width and a depth of the deformation notch 104 can be notably smaller than a width and a depth of the accommodation slot 11. The deformation notch 104 is larger in an upper portion and smaller in a lower portion, and it can be formed in various shapes, such as a semicircular shape, a trapezoid shape, and an inverted V shape. A region of a first bending part of the radiation fin 10 located between the deformation notches 104 and the communicating mouth 111 is defined as first riveting and deforming portions A. After the heat pipe 20 is disposed in the accommodation slot 11 of all radiation fins 10 which are locked together in a row, the first riveting and deforming portions A of the first bending part are riveted towards the heat pipe and thence they are deformed to clamp the heat pipe 20 in a tight fit manner.

The first bending part 102 is formed by bending a periphery of the accommodating slot 11 of the fin body 101 forwardly. Second bending parts 103 are formed by bending a left side and a right side of the fin body 101 respectively. The first bending part 102 and the second bending parts 103 can be bent with respect to the fin body 101 by an L shape, preferably by 90 degrees. An engagement hole 12 is formed on the second bending part 103. The engagement hole 12 has a rear opening 105. An engagement plate 13 is extended forwardly from a front end of the second bending part 103. The first bending part 102 and the second bending parts 103 are equal in width in a front-to-rear direction. After the radiation fins 10 are locked with each other in a row, the second bending parts 103 can be joined on the left side and the right side to constitute an integral configuration, and concurrently the first bending part 102 can be joined to constitute an integral configuration, thereby attaining a firm locking combination, a tight installation of the heat pipe 20, and a large area for heat dissipation.

All radiation fins 10 are locked together in succession, i.e. connected in a row as a clustered radiation fin set, by embedding the engagement plate 13 of one radiation fin 10 into the engagement hole 12 of another adjacent radiation fin in front. The riveting of the radiation fins 10 allows the first bending part 102 to clamp the heat pipe 20 in a tight fit manner. The first bending part 102 helps increase the contact area between the radiation fins 10 and the heat pipe 20 to enhance the clamping strength. Simultaneously, because the first bending part 102 and the second bending parts 103 are bent with respect to the fin body 101 by an L shape, the plate-shaped structure of the radiation fin 10 is equipped with a solid enhanced structure with multiple bending edges whereby the strength of a single radiation fin 10 is better, and the strength of the whole radiation fin set formed by clustering the radiation fins 10 together is also better for promoting the stability of combining the radiation fins 10 with the heat pipe 20 and the tightness of the tight fit and also increasing the heat dissipation effect.

The engagement hole 12 passes through the front face and the rear face of the fin body 101. The fin body 101 includes a stopper 106 inserted into the rear opening 105 in a left-to-right direction. The stopper 106 is inserted into the engagement hole 12 in a direction perpendicular to a locking direction, and the engagement hole 12 is extended forwardly into the engagement plate 13. A front end of the engagement hole 12 of one radiation fin 10 is engaged with the stopper 106 of another adjacent radiation fin 10 in front. This arrangement enhances the positioning of the radiation fins 10 in the front-to-rear direction to prevent their loosening and displacement, which allows the radiation fins 10 to have a firm, stable, and reliable structure after they are clustered together.

Figure 3:
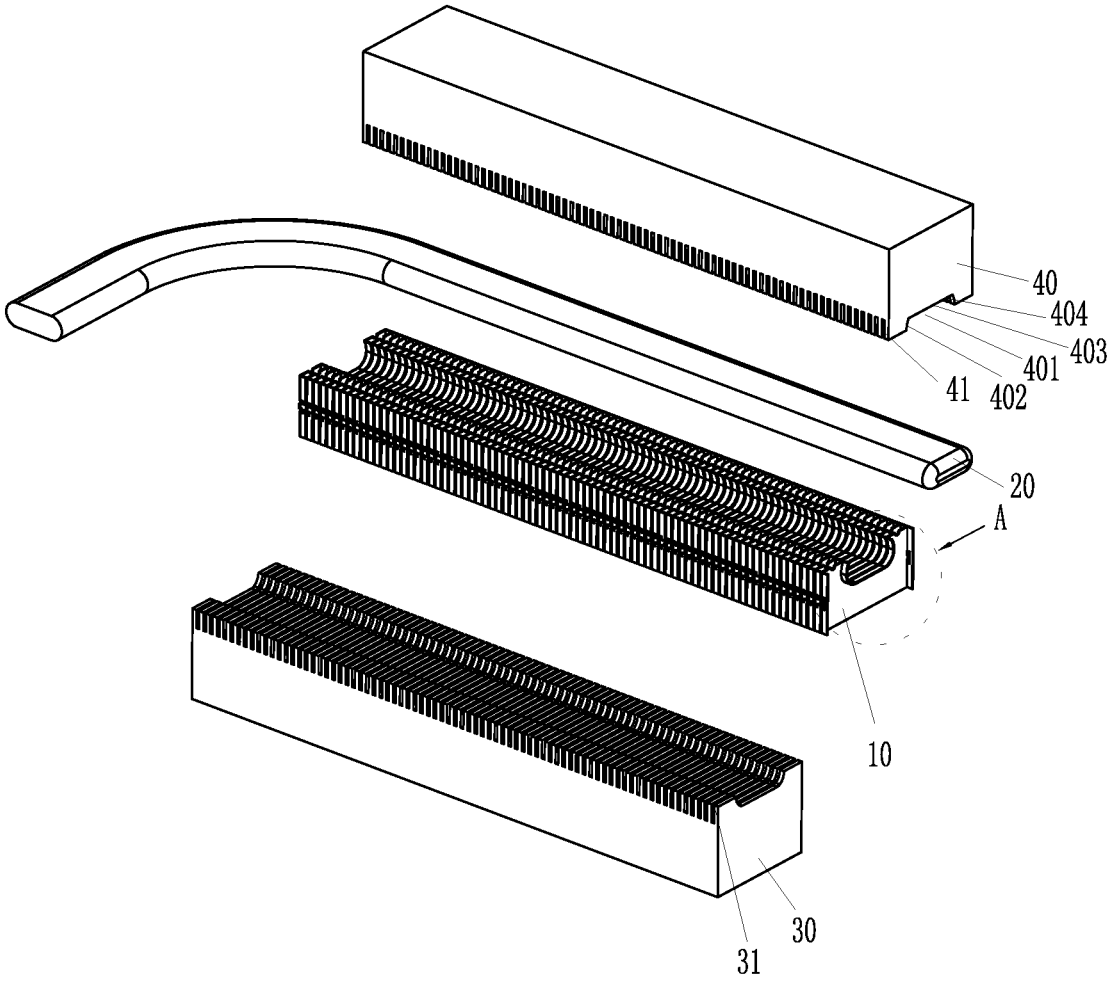
FIG. 3 is an exploded view showing the first preferred embodiment of this invention, including a lower fixing die and a riveting punch.
Figure 4:
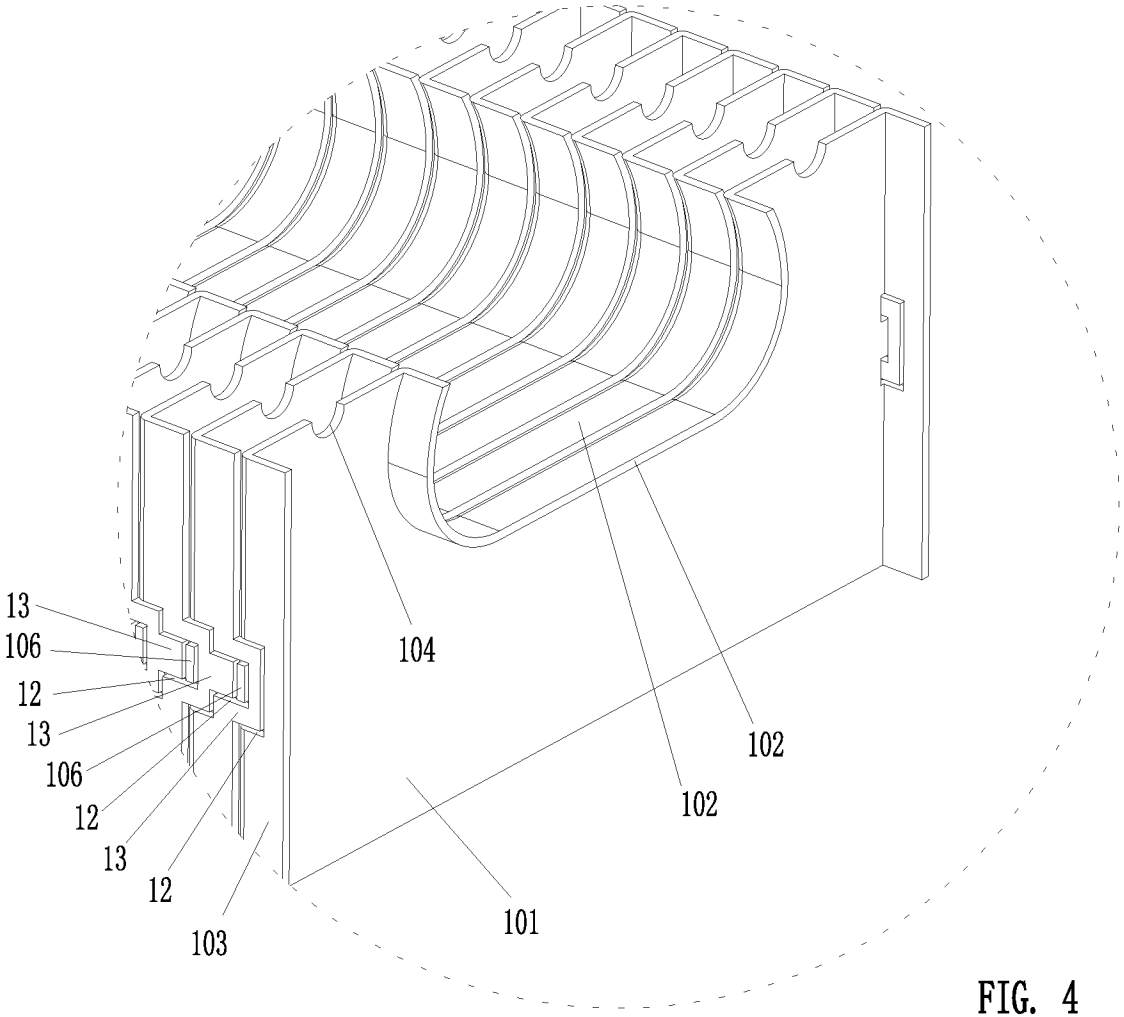
FIG. 4 is an enlarged view showing an encircled portion A of FIG. 3.
Figure 5:
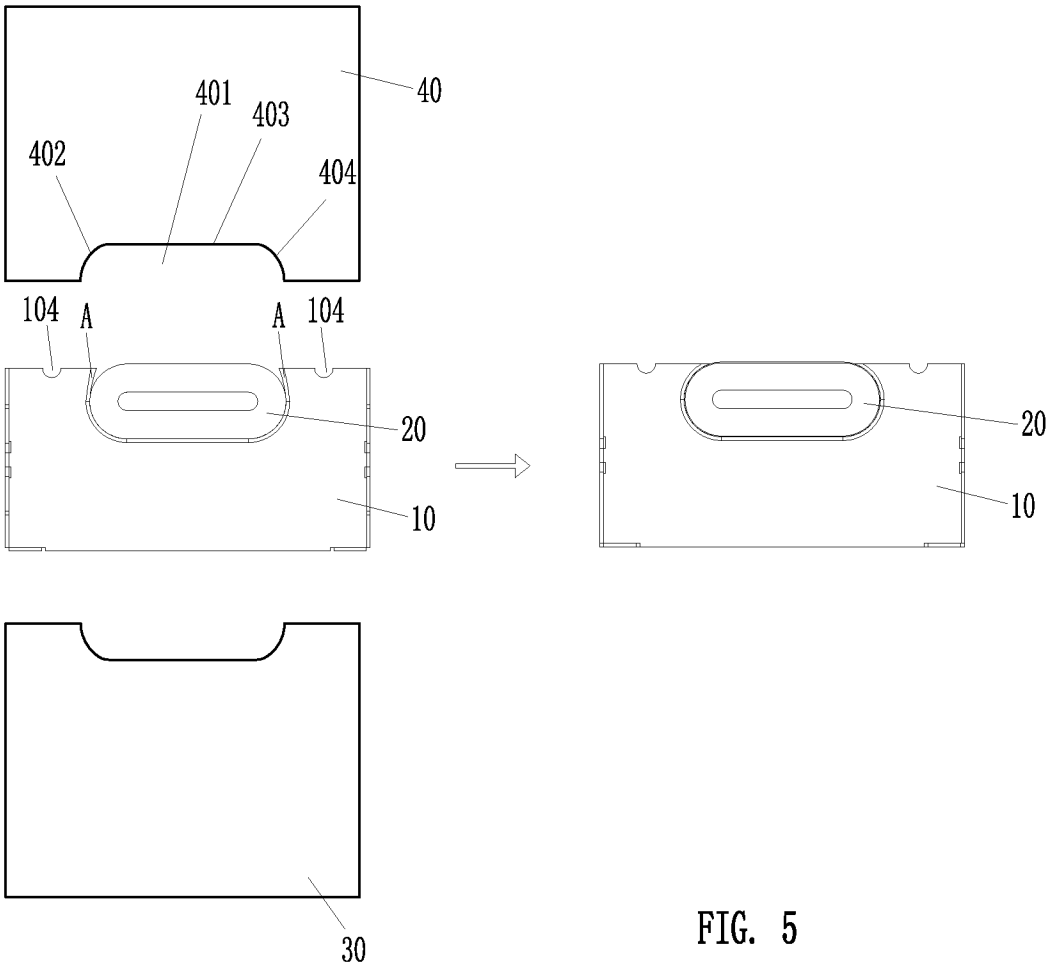
FIG. 5 is a schematic view showing a manufacturing process of the first preferred embodiment of this invention.
Figure 6:
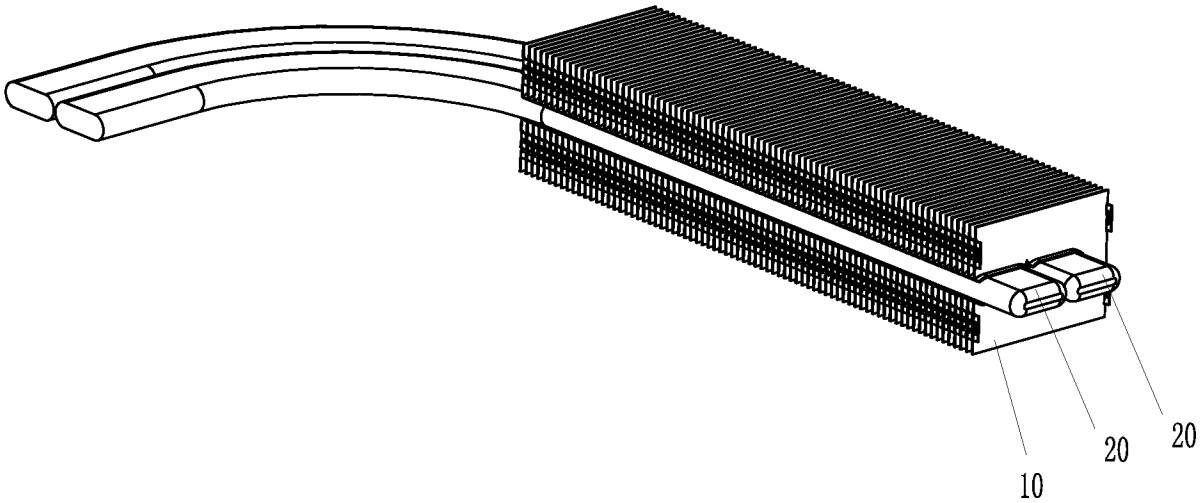
FIG. 6 is a schematic view showing a second preferred embodiment of this invention in a state of assemblage.
Figure 7:
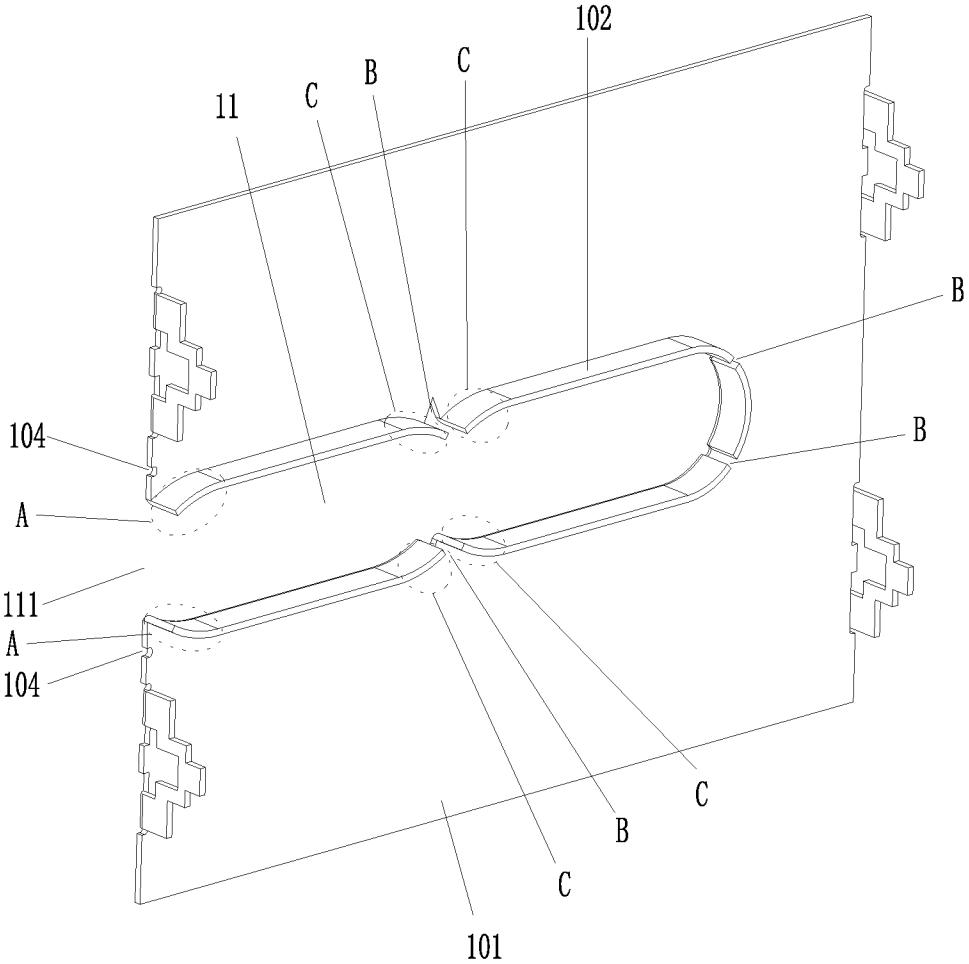
FIG. 7 is a schematic view showing a radiation fin of the second preferred embodiment of this invention.
Figure 8:
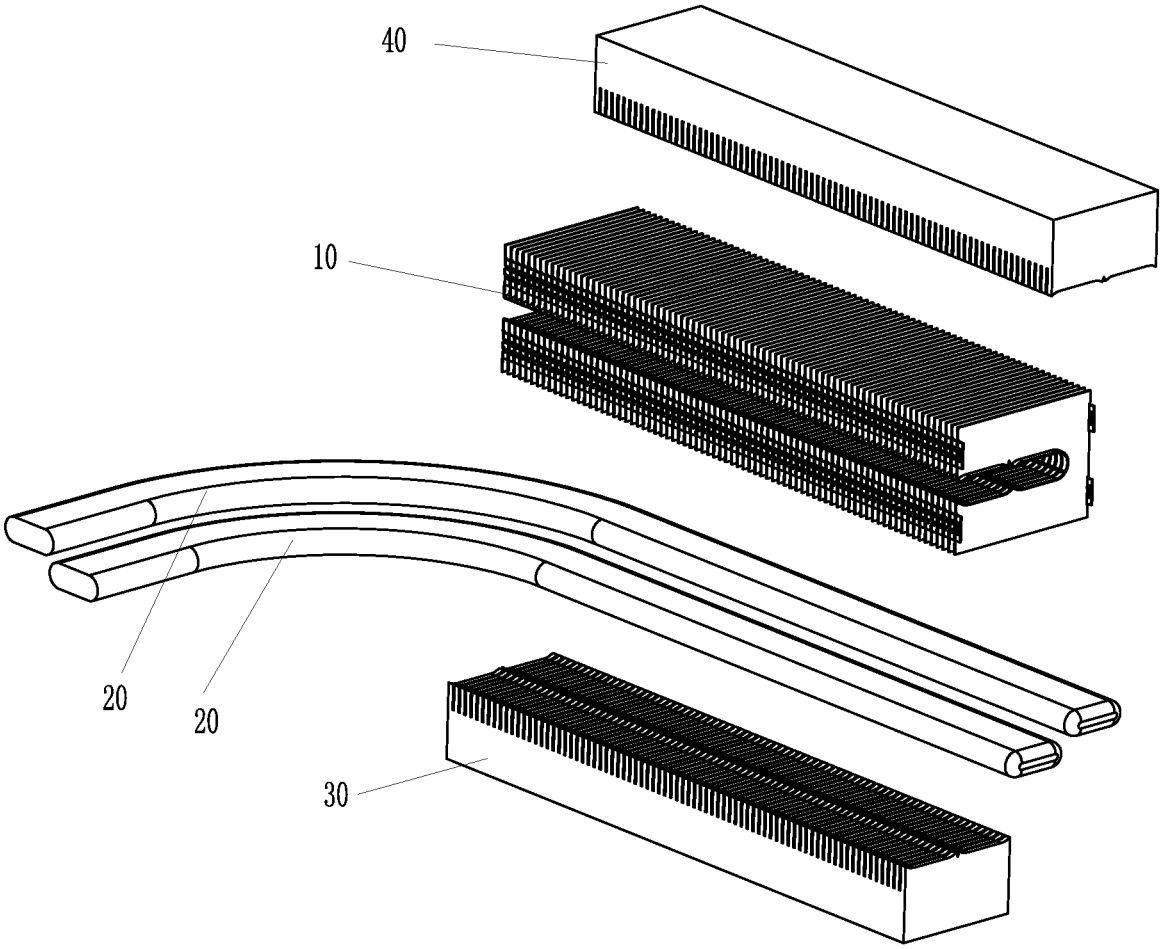
FIG. 8 is an exploded view showing the second preferred embodiment of this invention, including a lower fixing die and a riveting punch.
Figure 9:
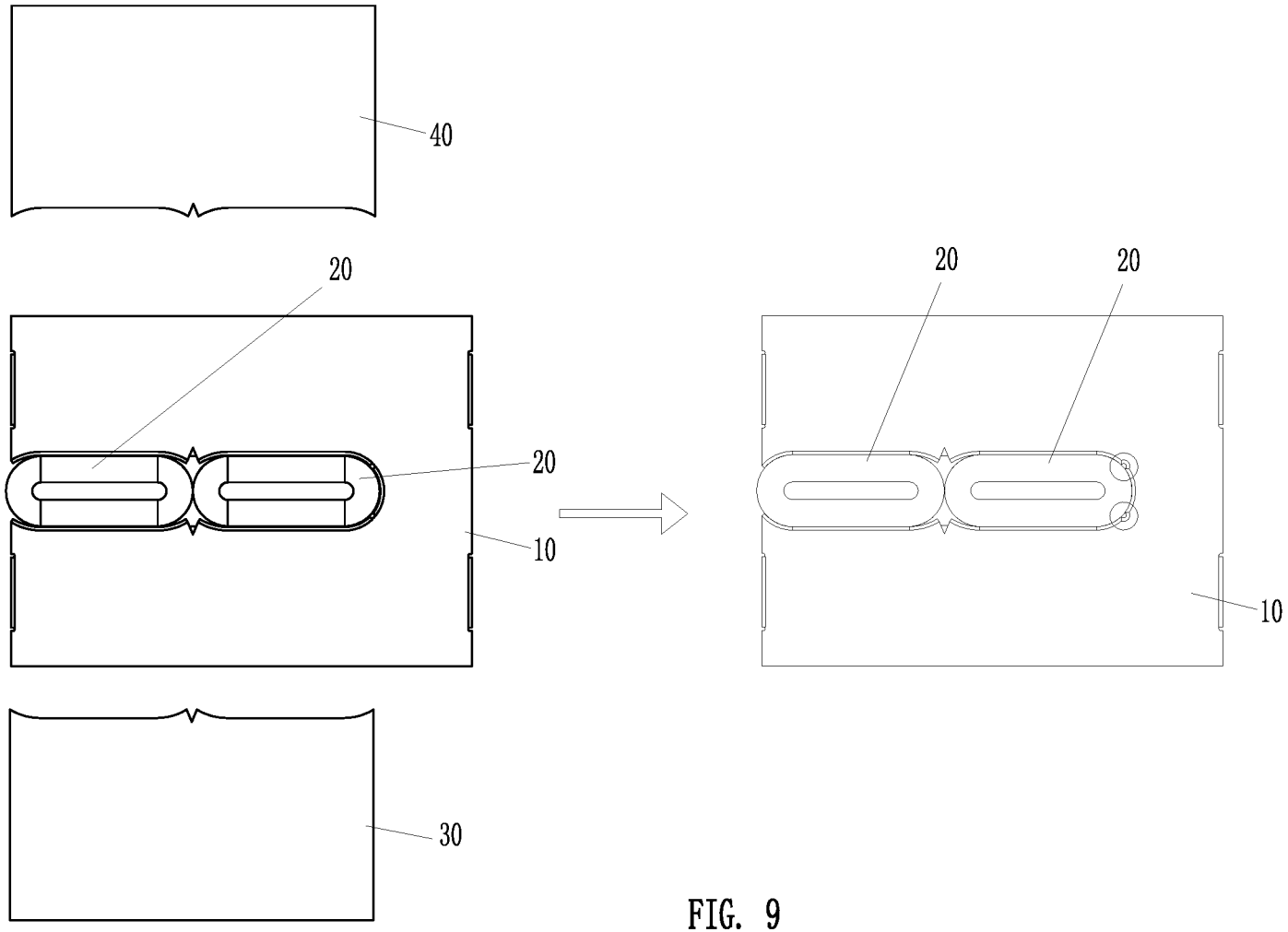
FIG. 9 is a schematic view showing a manufacturing process of the second preferred embodiment of this invention.
Figure 10:
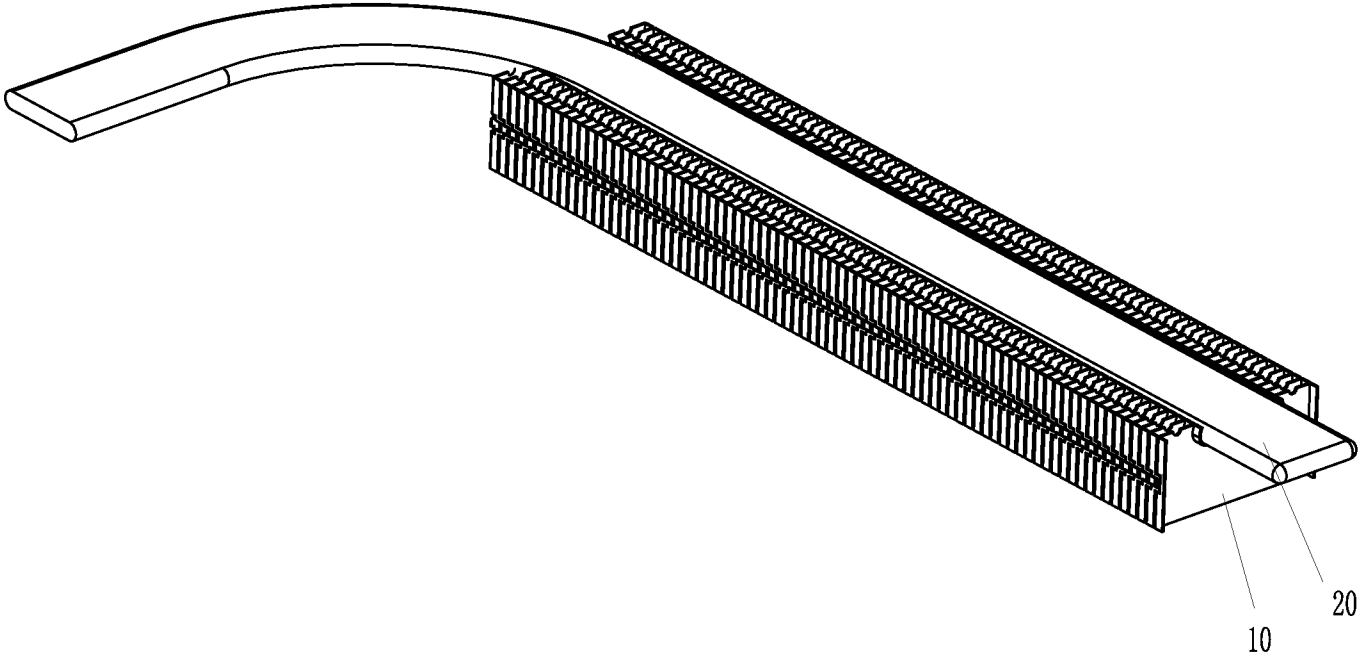
FIG. 10 is a schematic view showing a third preferred embodiment of this invention in a state of assemblage.
Figure 11:
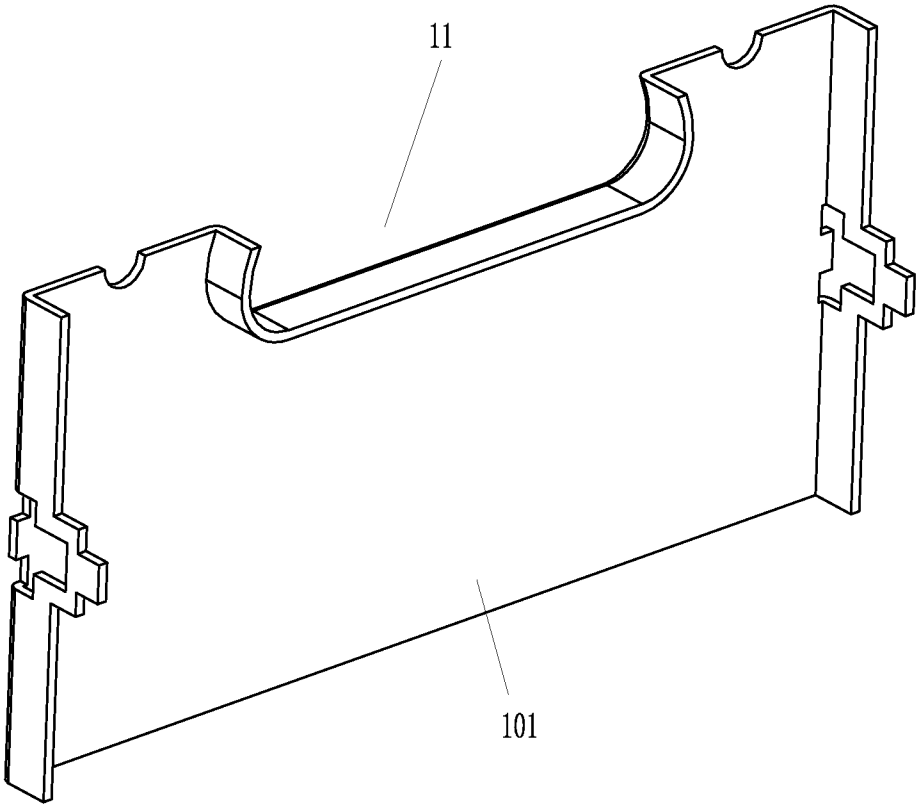
FIG. 11 is a schematic view showing a radiation fin of the third preferred embodiment of this invention.
Figure 12:
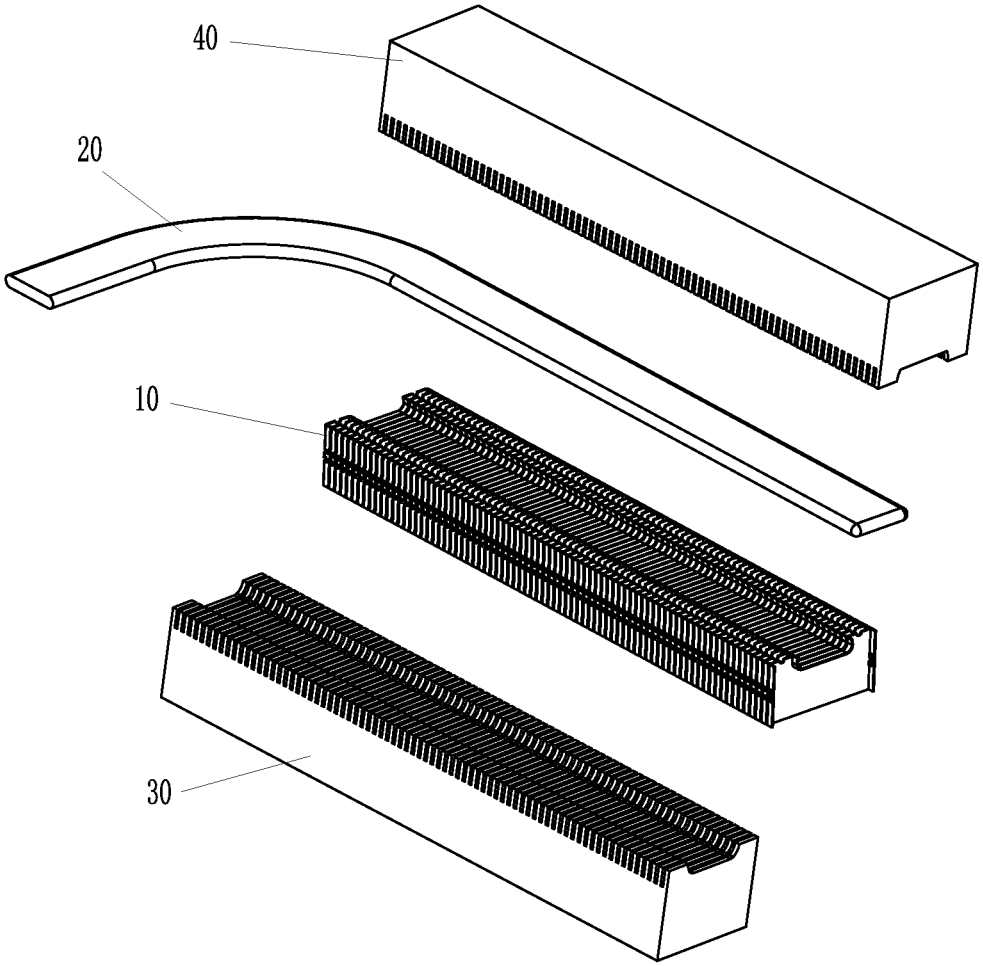
FIG. 12 is an exploded view showing the third preferred embodiment of this invention, including a lower fixing die and a riveting punch.
Figure 13:
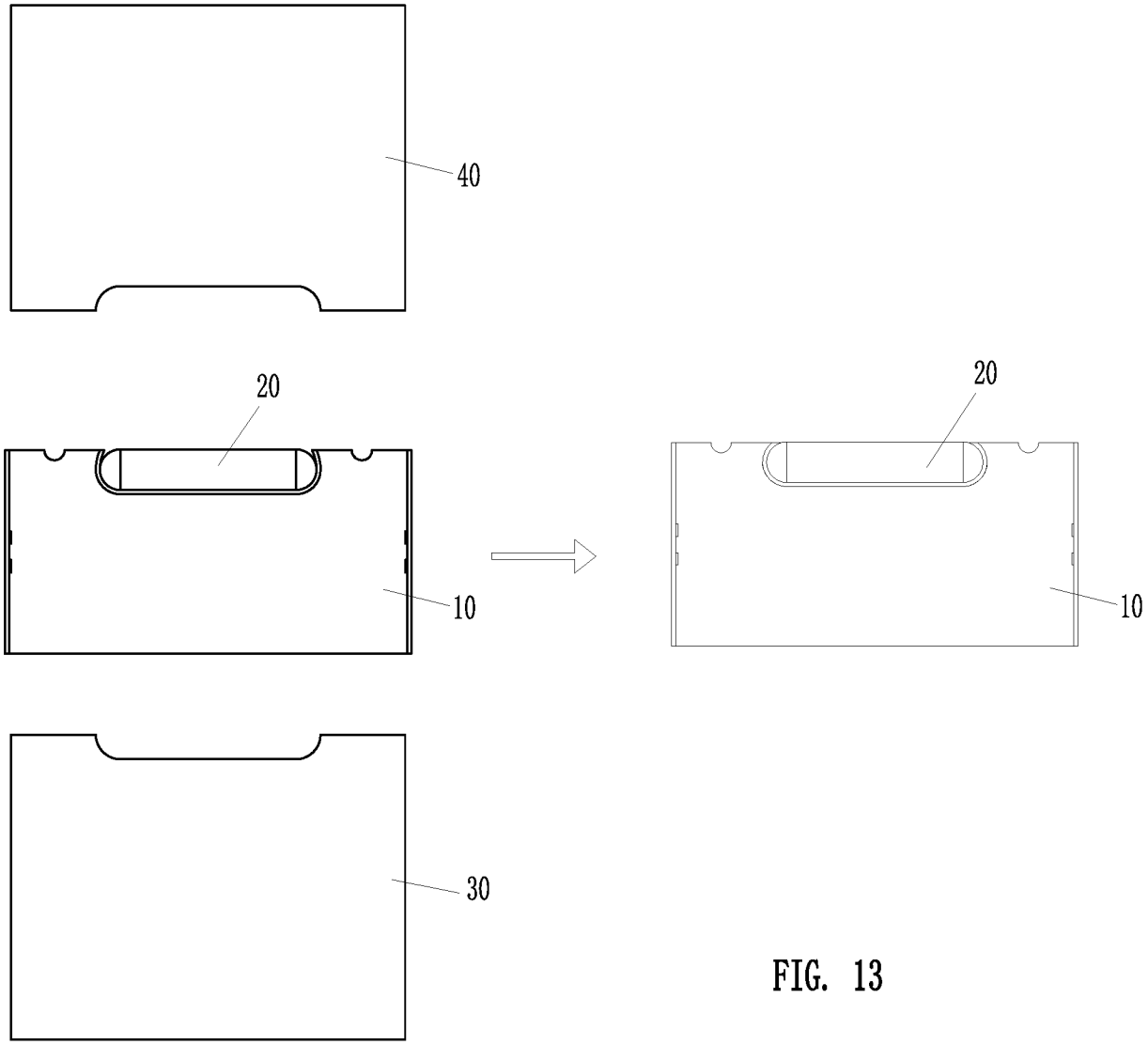
FIG. 13 is a schematic view showing a manufacturing process of the third preferred embodiment of this invention.
Figure 14:
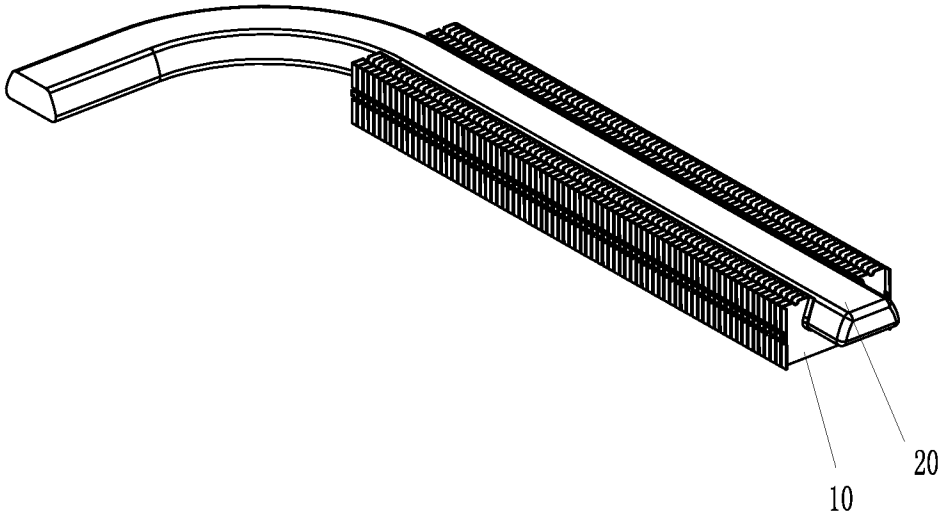
FIG. 14 is a schematic view showing a fourth preferred embodiment of this invention in a state of assemblage.
Figure 15:
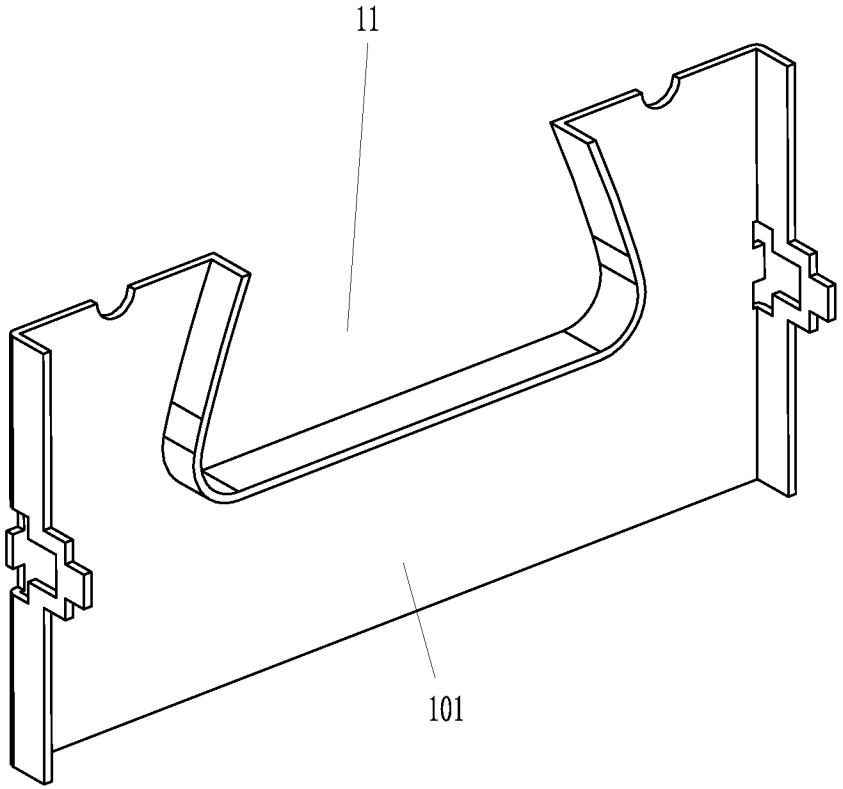
FIG. 15 is a schematic view showing a radiation fin of the fourth preferred embodiment of this invention.
Figure 16:
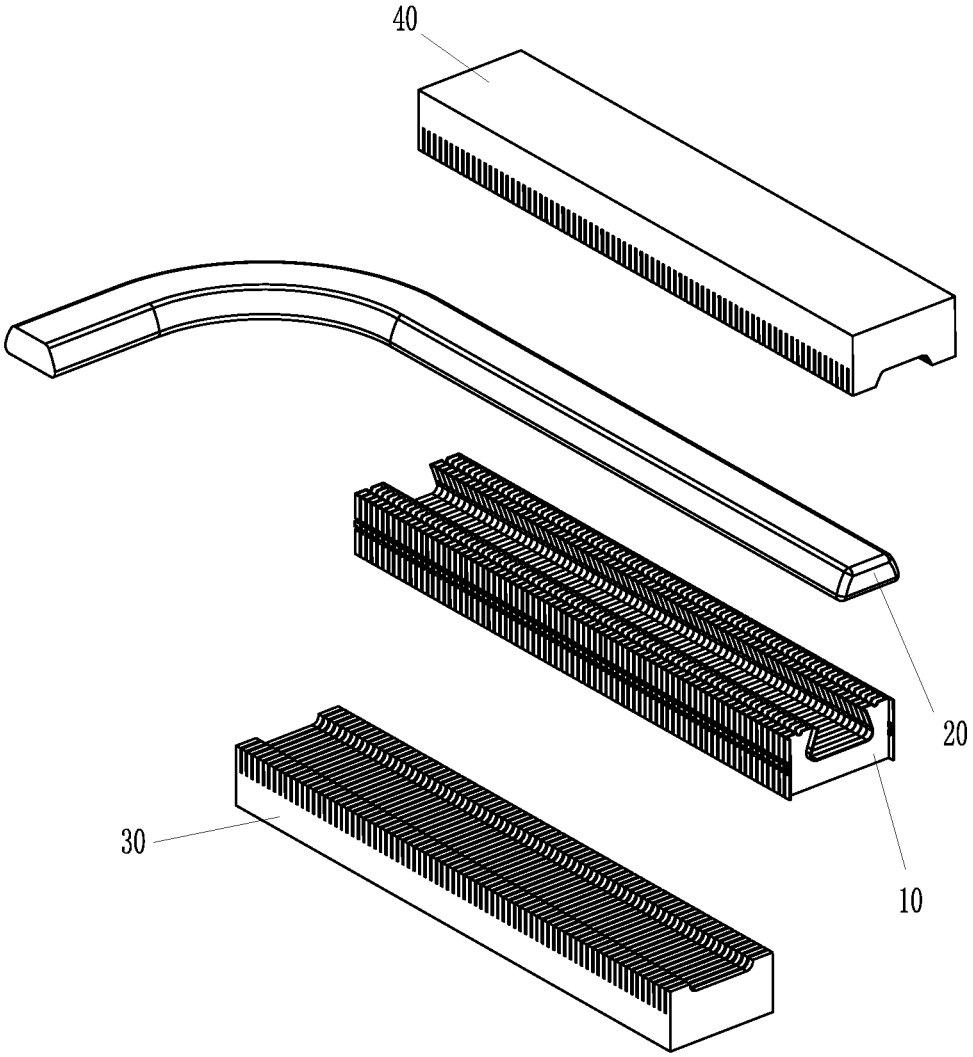
FIG. 16 is an exploded view showing the fourth preferred embodiment of this invention, including a lower fixing die and a riveting punch.
Figure 17:
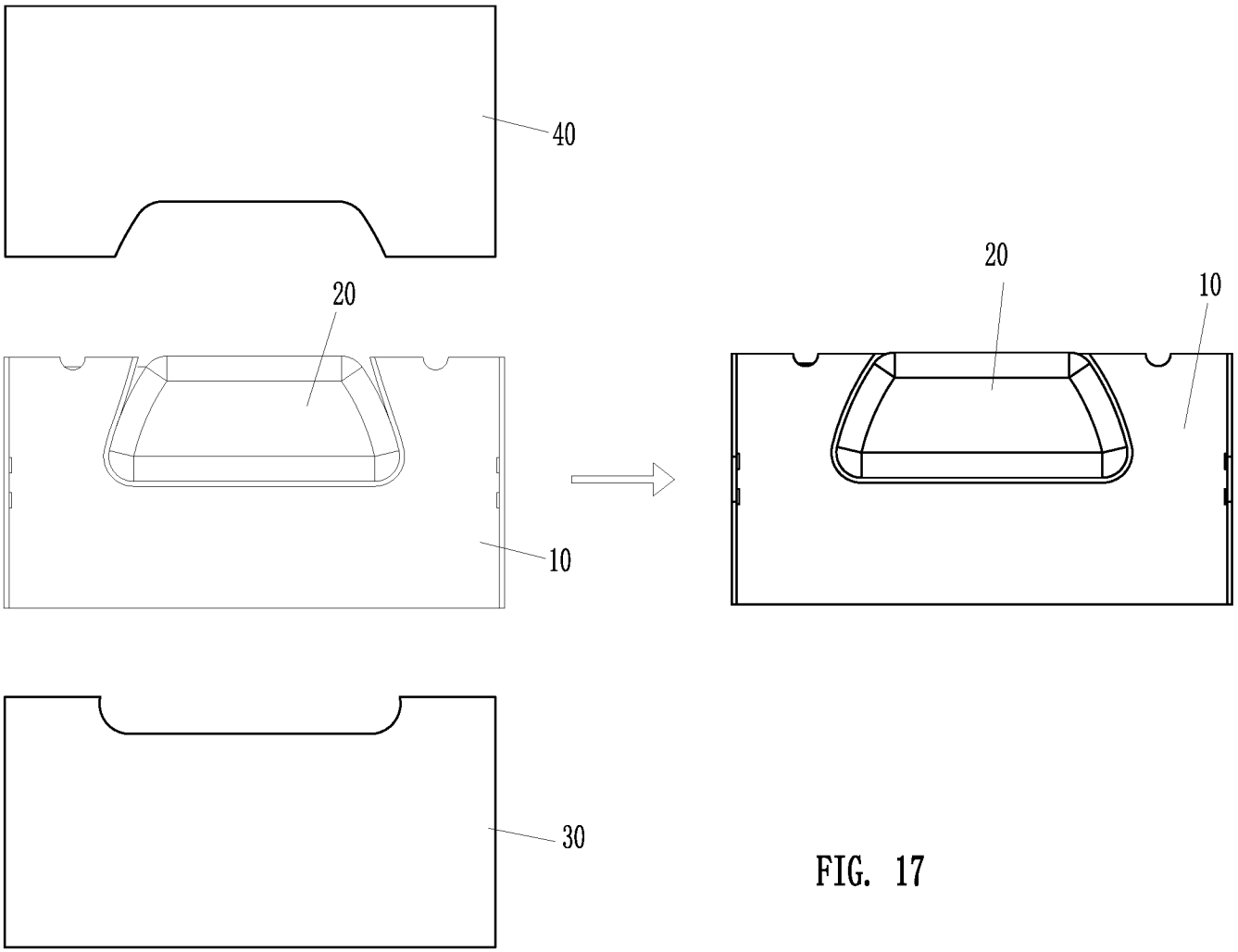
FIG. 17 is a schematic view showing a manufacturing process of the fourth preferred embodiment of this invention.

Next, referring to FIG. 3 and FIG. 5, a method of riveting the clustered radiation fin set to the heat pipe in a tight fit manner is based on the aforementioned tight-fit riveting structure for the clustered radiation fin set and the heat pipe. The method includes following steps.

Step 1: locking all radiation fins 10 in a row whereby a radiation fin set is defined, and then putting the heat pipe 20 from the communicating mouth 111 into the accommodation slot 11 formed on the radiation fins 10 of the radiation fin set.

Step 2: putting the clustered radiation fin set 10 and the heat pipe 20 into a lower fixing die 30. A top of the lower fixing die 30 is provided with a plurality of lower positioning plates 31 spaced from each other in the front-to-rear direction. The lower positioning plates 31 are each inserted upwardly into a space between adjacent fin bodies 101 of adjacent radiation fins 10, and the lower positioning plates 31 are adapted to abut against a bottom of each first bending part 102, thereby positioning each of the radiation fins 10 precisely to ensure that each first bending part 102 is in close contact with the heat pipe 20 for positioning while riveting.

Step 3: pressing a riveting punch 40 downwardly to a top of the radiation fin set so that the radiation fins 10 are pressed downwardly and shaped by riveting to allow multiple first bending parts 102 to clamp the heat pipe 20 for a tight fit. Wherein, the bottom of the riveting punch 40 is provided with a plurality of upper positioning plates 41 which are spaced from each other in the front-to-rear direction. The upper positioning plates 41 are each inserted downwardly into a space between adjacent fin bodies 101 of adjacent radiation fins 10. Accordingly, considering the lower fixing die 30 and the riveting punch 40, the first riveting and deforming portions A are riveted towards the heat pipe 20 by the pressing of the upper positioning plates 41 of the riveting punch 40, which causes the first riveting and deforming portions A to be deformed and allows the deformation to hold the heat pipe 20 in a tight fit manner. Therefore, the riveting between the radiation fins 10 and the heat pipe 20 is executed to fulfill the tight fit therebetween, and the riveting method is simple and reliable and is easy to operate.

In the first preferred embodiment, a bottom of each upper positioning plate 41 forms an upper riveting chamber 401. An inner wall of the upper riveting chamber 401 includes a left arched riveting surface 402, a top horizontal riveting surface 403, and a right arched riveting surface 404 which are connected in sequence. The top horizontal riveting surface 403 is adapted to abut against the heat pipe 20. The left arched riveting surface 402 and the right arched riveting surface 404 are adapted to press against the first riveting and deforming portions A on two sides respectively. When the riveting punch 40 is pressed downwards, the first riveting and deforming portions A are riveted downwardly and inwardly towards the heat pipe 20 so that the first riveting and deforming portions A are deformed to fit the heat pipe 20 snugly.

Referring to FIG. 6 through FIG. 9, a structure of a second preferred embodiment is shown. The second preferred embodiment and the first preferred embodiment have the same basic structure. The second preferred embodiment differs from the first preferred embodiment in defining the communicating mouth 111 on a left face (or a right face) of the fin body 101. Therefore, in Step 3, the upper positioning plates 41 are adapted to press against the top of the first bending parts 102. It is stated herein that there can be two (or more than two) heat pipes 20. On the periphery of the accommodation slot 11 are formed break slots B whereby the first bending part 102 is divided into two or more than two sections. In addition, the break slots are extended into the fin body 101, which causes the first bending part 102 to be cut and then bent to fit the contour of the heat pipe 20. The sections of the first bending part located on two sides of each break slot B are bent towards the accommodation slot 11 to thereby define second riveting and deforming portions C.

In the second preferred embodiment, the communicating mouth 111 is defined on the left face of the fin body 101, and the first riveting and deforming portions A are respectively formed on an upper side and a lower side of the communicating mouth 111. The upper positioning plates 41 are adapted to press against an upper part of the upper-sided first riveting and deforming portions A, and the lower positioning plates 31 are adapted to abut against a lower part of the lower-sided first riveting and deforming portions A. When the riveting punch 40 is pressed downwards, the upper-sided first riveting and deforming portions A are concurrently riveted downwardly and rightwardly towards the heat pipe 20 under the force added by the upper positioning plates 41 and thence are deformed to closely fit an upper side of the heat pipe 20, and simultaneously the lower-sided first riveting and deforming portions A forced by the lower positioning plates 31 are concurrently riveted upwardly and rightwardly towards the heat pipe 20 and thence are deformed to closely fit a lower side of the heat pipe 20. When the riveting punch 40 is pressed downwards, the upper-sided second riveting and deforming portions C are riveted towards the heat pipe 20 under the force added by the upper positioning plates 41 and thence are deformed to closely fit the heat pipe 20, and the lower-sided second riveting and deforming portions C are also forced by the lower positioning plates 31 to be riveted towards the heat pipe 20 and thence be deformed to closely fit the heat pipe 20.

Referring to FIG. 10 through FIG. 13, a structure of a third preferred embodiment is shown. The third preferred embodiment and the first preferred embodiment have the same basic structure. The third preferred embodiment differs from the first preferred embodiment in having a thinner heat pipe 20 whereby the depth of the accommodation slot 11 is reduced. On the lower fixing die 30 and the riveting punch 40 are formed opposite curved surfaces adapted to fit the contour of the heat pipe 20, same as the first preferred embodiment.

Referring to FIG. 14 through FIG. 17, a structure of a fourth preferred embodiment is shown. The fourth preferred embodiment and the first preferred embodiment have the same basic structure. The fourth preferred embodiment differs from the first preferred embodiment in having a thicker heat pipe 20 whereby the depth of the accommodation slot 11 is increased. The cross section of the heat pipe 20 is formed in a shape of a trapezoid (or called a quasi-trapezoid) which is smaller in an upper portion and larger in a lower portion.

It is noted that the left side and the right side of the heat pipe 20 have curvedly-chamfered parts near the top and the bottom thereof, so the heat pipe 20 possesses an introducer design beneficial to the installation of the heat pipe 20. Therefore, it is easier to put the heat pipe 20. Although the communicating mouth 111 is smaller than the accommodation slot 11, the heat pipe 20 is smoothly embedded into the accommodation slot 11 by the cooperation between the curvedly-chamfered parts of the heat pipe 20 and the outward deformation of the communicating mouth 111 of the radiation fin 10.

What is claimed is:

1. A method of riveting a clustered radiation fin set to a heat pipe in a tight fit manner being based on a tight-fit riveting structure, the tight-fit riveting structure comprising: a radiation fin set defined by locking a plurality of radiation fins together and at least one heat pipe, said radiation fin set including an accommodation slot adapted to accommodate said at least one heat pipe, said at least one heat pipe being located in said accommodation slot, and said at least one heat pipe being positioned in said accommodation slot in a tight fit manner by subjecting two sides of said accommodation slot of said radiation fin set to a riveting operation; said plurality of radiation fins each including a fin body, said accommodation slot being formed on said fin body and formed by passing through a front face and a rear face of said fin body, said accommodation slot defining a communicating mouth passing through a peripheral edge of said fin body, said peripheral edge of said fin body having respective deformation notches recessedly formed on two sides of said communicating mouth, a first bending part being formed by bending a periphery of said accommodating slot of said fin body forwardly, said first bending part being bent with respect to said fin body by an L shape, a region of said first bending part of each said radiation fin located between said deformation notches and said communicating mouth being defined as first riveting and deforming portions; two side edges of said fin body being each bent forwardly and provided with an engagement plate, an engagement hole being formed on said engagement plate, whereby said plurality of radiation fins are locked together as said radiation fin set by embedding said engagement plate of one radiation fin into said engagement hole of said engagement plate of an adjacent one of said radiation fins in front of said one radiation fin; and after said at least one heat pipe is disposed in said accommodation slot of said radiation fin set, said first riveting and deforming portions on said two sides of said communicating mouth of said accommodation slot being riveted towards a surface of said at least one heat pipe, and said first riveting and deforming portions thereby being deformed to clamp said at least one heat pipe in a tight fit manner;

the method comprising:

step 1: locking all of said plurality of radiation fins in a row whereby said radiation fin set is defined and then putting said at least one heat pipe into said accommodation slot formed on said radiation fin set;

step 2: putting said radiation fins which are locked in a row and said at least one heat pipe into a lower fixing die, a top of said lower fixing die being provided with a plurality of lower positioning plates, with said plurality of lower positioning plates arranged to correspond to spaces between said plurality of radiation fins of said radiation fin set, with said plurality of lower positioning plates adapted to abut against a bottom of said first bending part of each of said plurality of radiation fins; and step 3: preparing a riveting punch whose bottom is provided with a plurality of upper positioning plates arranged to correspond to said spaces between said plurality of radiation fins of said radiation fin set, and riveting said first riveting and deforming portions towards said at least one heat pipe by a pressing of said plurality of upper positioning plates of said riveting punch, and said first riveting and deforming portions thereby being deformed to clamp said at least one heat pipe in a tight fit manner.

2. The method of riveting the clustered radiation fin set to the heat pipe in the tight fit manner according to claim 1, wherein said communicating mouth is defined on an upper face of said fin body, a bottom of each of said plurality of upper positioning plates forming an upper riveting chamber, an inner wall of said upper riveting chamber including a left arched riveting surface, a top horizontal riveting surface, and a right arched riveting surface which are connected in sequence, said top horizontal riveting surface being adapted to abut against said at least one heat pipe, said left arched riveting surface and said right arched riveting surface being adapted to press against said first riveting and deforming portions respectively; said first riveting and deforming portions being riveted downwardly and inwardly towards said at least one heat pipe while pressing said riveting punch downwards, and said first riveting and deforming portions thereby being deformed to closely fit said at least one heat pipe.

* * * * *